US011712095B1

(12) United States Patent
Zayach

(10) Patent No.: US 11,712,095 B1
(45) Date of Patent: Aug. 1, 2023

(54) HEAT-RESISTANT, FLEXIBLE, SEMI-MODULAR, ORGANIZATIONAL, DESKTOP WORKPLACE MAT

(71) Applicant: Andrew Zayach, Cottonwood Heights, UT (US)

(72) Inventor: Andrew Zayach, Cottonwood Heights, UT (US)

( * ) Notice: Subject to any disclaimer, the term of this patent is extended or adjusted under 35 U.S.C. 154(b) by 0 days.

(21) Appl. No.: 17/851,977

(22) Filed: Jun. 28, 2022

(51) Int. Cl.
*A45C 11/34* (2006.01)
*B43M 99/00* (2010.01)

(52) U.S. Cl.
CPC ..... *A45C 11/34* (2013.01); *B43M 99/001* (2013.01)

(58) Field of Classification Search
CPC ..... A45C 11/34; B43M 99/001
USPC ..... 206/214, 224, 371; 211/10
See application file for complete search history.

(56) References Cited

U.S. PATENT DOCUMENTS 4,802,593 A * 2/1989 Romanos ..... B43M 99/00 211/10
4,953,696 A * 9/1990 Huang ..... B43M 99/008 206/214
4,991,712 A * 2/1991 Wagner ..... B43M 99/008 206/214
5,224,594 A * 7/1993 Hou ..... B43M 99/001 206/214
5,740,906 A * 4/1998 Lai ..... A45C 11/24 206/214
6,220,429 B1 * 4/2001 Pasch ..... B65H 35/0026 206/214
6,591,990 B2 * 7/2003 Lanman ..... B43M 99/001 206/214
7,273,148 B2 * 9/2007 Perry ..... B25H 3/00 206/214
10,492,583 B1 * 12/2019 Potter ..... A63J 21/00
11,026,508 B1 * 6/2021 Lehoe ..... B43K 23/001
2009/0139880 A1 * 6/2009 Abdullah ..... A45C 11/36 206/214
2009/0166245 A1 * 7/2009 Cetera ..... A47G 23/00 283/67
2017/0174392 A1 * 6/2017 De Loynes ..... A45C 7/005
2018/0199690 A1 * 7/2018 Steele ..... A45D 33/006
2018/0317649 A1 * 11/2018 Kasravi ..... B43M 99/001

* cited by examiner

*Primary Examiner* — Jacob K Ackun
(74) *Attorney, Agent, or Firm* — Steven Rinehart

(57) ABSTRACT

A heat-resistant and solvent-resistant, protective desktop mat comprising a plurality of substantially hexagonal components including a main body, a tab and a plurality of receptacles, the mat assemblable with other mats to cover a larger surface area of a desktop or workstation surface and adapted to assist in manual assembly operations.

13 Claims, 8 Drawing Sheets

HEAT-RESISTANT, FLEXIBLE, SEMI-MODULAR, ORGANIZATIONAL, DESKTOP WORKPLACE MAT

BACKGROUND OF THE INVENTION

Field of the Invention

This invention relates to a workplace safety equipment, and more particularly relates to implements adapted to facilitate organization and use of a plurality of tools in a desktop, workplace environment.

Description of the Related Art

Typically, individuals tasked with assembling and organizing small- and medium-sized items sit at a workstation or desk to perform these tasks. These tasks include soldering, screwing, assembling, cutting, sewing, mixing chemicals, writing, painting, prying and other manual operations.

Many US workers find themselves seated and isolated at wood, steel or polymeric desks or workstations for long periods of time during working hours. Without protection, these desktop surfaces can become scratched, burned, marred, and slowly destroyed.

There exist few implements in the art adapted to protect these surfaces, much less implements which add to the utility of the desktop surface and work area. Writing pads are known, which typically comprise soft mats affixed temporarily or permanently to a desktop surface, as are mousepads and other simple planar desktop implements. These mats cannot be combined to cover large or small desktop area, as would be optimal. They are not modularized and provide no means for organizing, storing or porting tools and implements.

Current technology in the art is inefficient to provide optimal assistance to typical workers performing basic assembly function. The present invention aims to cure these deficiencies in the art by providing a flexible mat which is heat-resistant, portable, and which includes features adapted to improve tool organization and utility. The present invention may also allow user to enjoy the benefits of vaporized oils and concentrates using a mat adapted to assist in this purpose.

SUMMARY OF THE INVENTION

From the foregoing discussion, it should be apparent that a need exists for a protective desktop mat. Beneficially, such an apparatus would overcome many of the difficulties and safety concerns expressed, by providing a heat-resistant, portable, polymeric mat.

The present invention has been developed in response to the problems and needs in the art that have not yet been fully solved by currently available apparati and methods. Accordingly, the present invention has been developed to provide a protective desktop mat comprising: a substantially hexagonal main body having a planar top surface and a planar bottom surface; a substantially hexagonal tab protruding laterally from the main body, the substantially hexagonal tab having four or more exposed sides; a plurality of hexagonal receptacles affixed to the main body, the hexagonal receptacles rising superiorly from the main body, the hexagonal receptacles circumscribing one or more edges of the main body, where in each hexagonal receptacle defines a cylindrical, hollow interior recess having an open top end.

The main body, hexagonal tab and receptacles may all be formed as a single integrated piece. The protective desktop mat may be formed from silicone. Each of the receptacles form a hollow interior cylindrical recess having an open top surface. One or more receptacles may be separated on one or more sides from one of an adjacent receptacle and the main body. Two or more receptacles may vary in diameter and depth from one or more remaining receptacles.

In some embodiments, the protective desktop mat may further comprise a plurality of hexagonal recesses defined by a top surface of the main body. The protective desktop mat may further comprise a plurality of elongated slots positioning between receptacles abutting one another, the elongated slots adapted to secure elongated handheld instruments.

Each receptacle may comprise an annular lip which circumscribes a top end of a hollow interior recess. The lip may be interrupted by one or more expansion joints. The receptacles may be detachable. The protective desktop mat may further comprise a plurality of magnets disposed around a perimeter of the mat. A plurality of edges of the mat may be predetermined to extend in length between 20-45% of the length of a longest edge of the mat.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It an object of the present invention to provide a heat-resistant, portable, modularized, flexible workstation mat which may be combined with other mats to cover a desktop surface.

Figure 1:
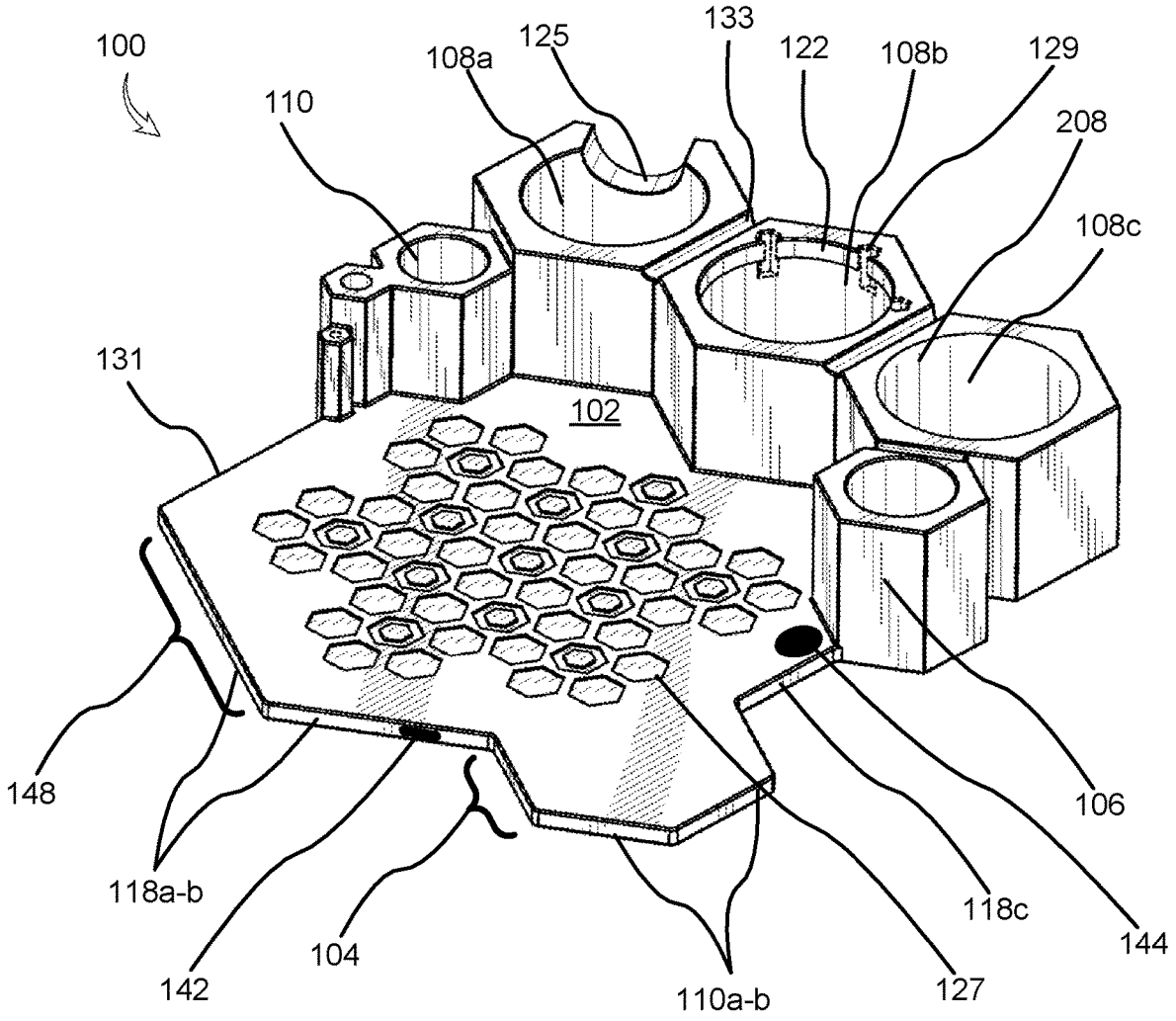
FIG. 1 illustrates an isometric view of a protective desktop mat in accordance with the present invention.
Figure 2:
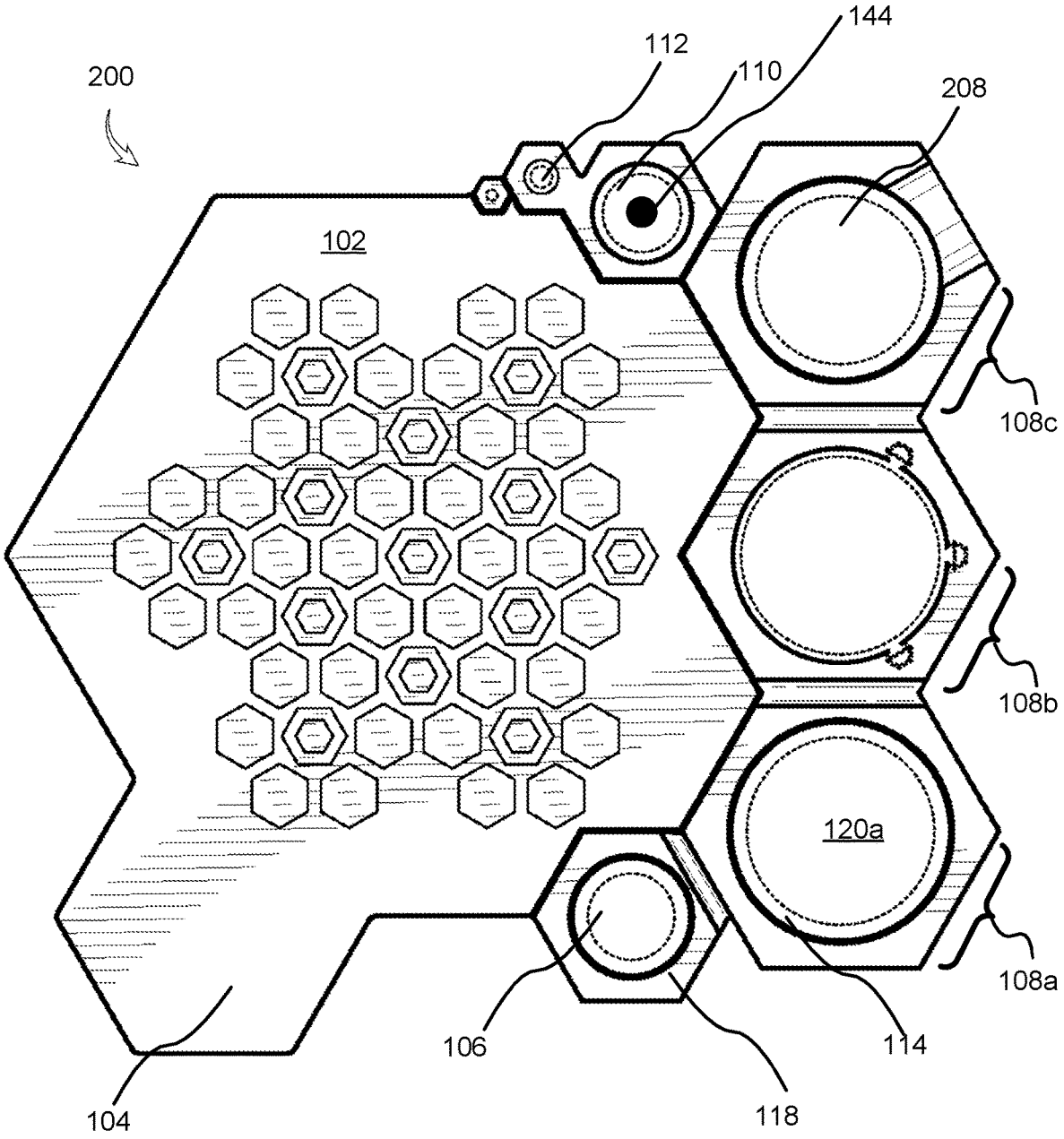
FIG. 2 illustrates a top view of a protective desktop mat in accordance with the present invention.

FIGS. 1-2 illustrates views of a protective desktop mat 100, 200 in accordance with the present invention.

The mat 100 comprises largely hexagonal components. The main body 102 of the mat 100 is substantially hexagonal in shape when integrated components are reduced from the overall design. The main body 102 comprises a plurality of straight sides 118 forming an overall hexagonal appearance of the main body 102.

The main body 102 is integrated with a tab 104 which itself is hexagonal when reduced from the main body 102 comprising a plurality of sides 110. The tab 104 protrudes laterally from the main body 102 comprising four exposed sides 110.

A plurality of receptacles 106, 108 circumscribe one more edges 108 of the main body 102. These receptacles 106, 108 may vary in height, diameter, depth, and function. In various embodiments, the receptacles 106, 108 are hexagonal from a top perspective around an outside perimeter 118 of the receptacles 106, 108.

Each receptacle 106, 108 comprises a hollow interior recess 120. These recesses 120 may be cylindrical as shown. The receptacles 106, 108*a-c* abut one another as they circumscribe the perimeter of the main body 102. The receptacles 106, 108 may circumscribe some edges 108 partially or entirely. In some embodiments, the receptacles 106, 108 circumscribe the main body 102 entirely.

One or more of the receptacles 106, 108*a*, 108*b*, 108*c* may comprises an annular inner lip 122 which circumscribes the open top end of the receptacle 106, 108 interiorly. This annular lip 122 is adapted to allow brushes to be wiped off within the receptacle to wipe off viscous materials from the brush or implements such as paint dripping down the sides of the receptacles 106, 108.

The receptacles 106, 108*a-c* may be octagonal in shape in some embodiments. One or more of the receptacles 108*a-c* may define a semi-circular recess 125 as shown adapted for receiving and securing at rest one or more ancillary cylindrical components. The receptacles 112, 110, 106, 108*a-c* circumscribe a rearward edge of the mat 102. In various embodiments, the top surface of the mat 102 is textured. The mat may be textured with hexagonal recesses 127 as shown, adapted to form a slip resistant surface.

The receptacle 110 may be smaller in diameter than the receptacles 108*a-c* and/or may be equal in diameter to receptacle 106. In various embodiments, the larger receptacles 108*a-c* position between the smaller receptacles 110, 106 on the rearward surface of the mat 102.

In various embodiments, the lip 122 may be interrupted by a plurality of expansion joints 129 comprising slots or recesses allowing the lip 122 to expand to receive larger inserted ancillary components than would otherwise be possible. These ancillary components may be cylinders, beakers, test tubes, and the like.

Each of the receptacles 106, 108, 110, and 112 defines a cylindrical, hollow interior recess 208 having an open top end.

A slot 133 may position between receptacle 108*a* and 108*b*, and receptacles 108*b* and 108*c*, as well as receptacle 108*c* and 106. These concave slots 133 are adapted to receive and secure at rest elongated handheld implements, such as pens, pencils, stirring implements, and the like.

In various embodiments, a plurality of magnets 142 position around the perimeter of the mat 102 adapted for mating with corresponding magnets 142 disposed around the perimeter of adjoining mats 102 as shown in relation to FIG. 3 below.

The apparatus 100 may also comprise a plurality of magnets 144 disposed about the top surface of the mat 102. These magnets 144 are useful for forming a magnetic fit with a corresponding magnet 144 on the lower surface of a receptacle 106, 108, 110, 112. In various embodiments, the receptacles 106, 108, 110, 112 are detachable from the mat 102 surface, and may be repositioned above magnets 144 disposed about the mat 102.

In various embodiments, the length of the edges, including edge 104, are predetermined to conform to a ratio of the length of the longer edge 148 (or longest edge). The edge 104 may be predetermined to extend in length from 20-45% of the length of the longer edge 104. In the shown embodiment, the edge 104 is 33 mm in length and the longest edge 148 is 86.603 mm in length. In various embodiments, the edge 104 is 38.1% as long as edge 148, or between 38.0% and 38.2% as long.

Figure 3:
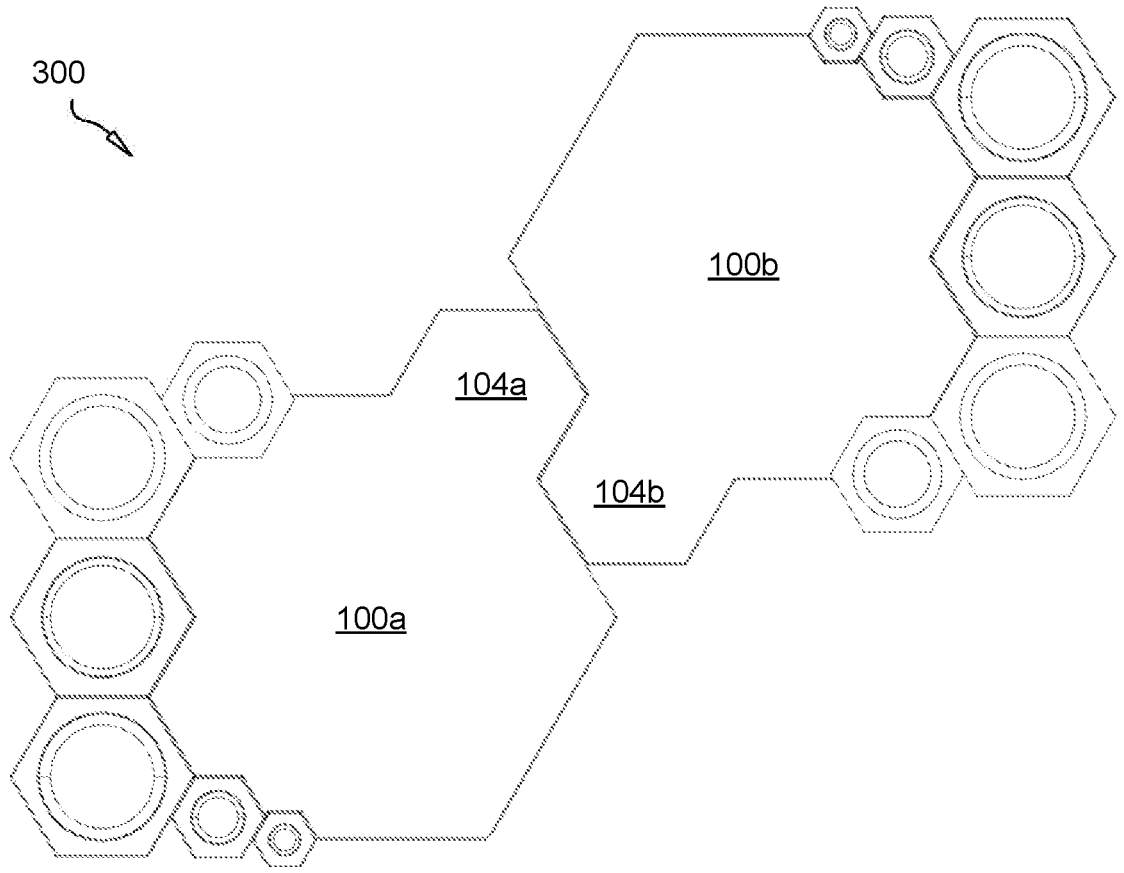
FIG. 3 illustrates a top view of two assembled protective desktop mats in accordance with the present invention.

FIG. 3 illustrates a top view of two assembled protective desktop mats in accordance with the present invention.

As shown, two mats 100 may be interlocked with one another, or placed adjacent to one another (typically with a minimum of three sides abutting one another), to form an assembly 300 which covers a larger surface area than a single mat 100 alone. In the shown embodiment, the tabs 104 sit side-by-side each abutting an edge of a main body 102.

The portion of the mat 102 comprises eight edges 131 which are not affixed to, or covered with, the receptacles 106, 108*a-c*, 110, 112, 106.

Figure 4:
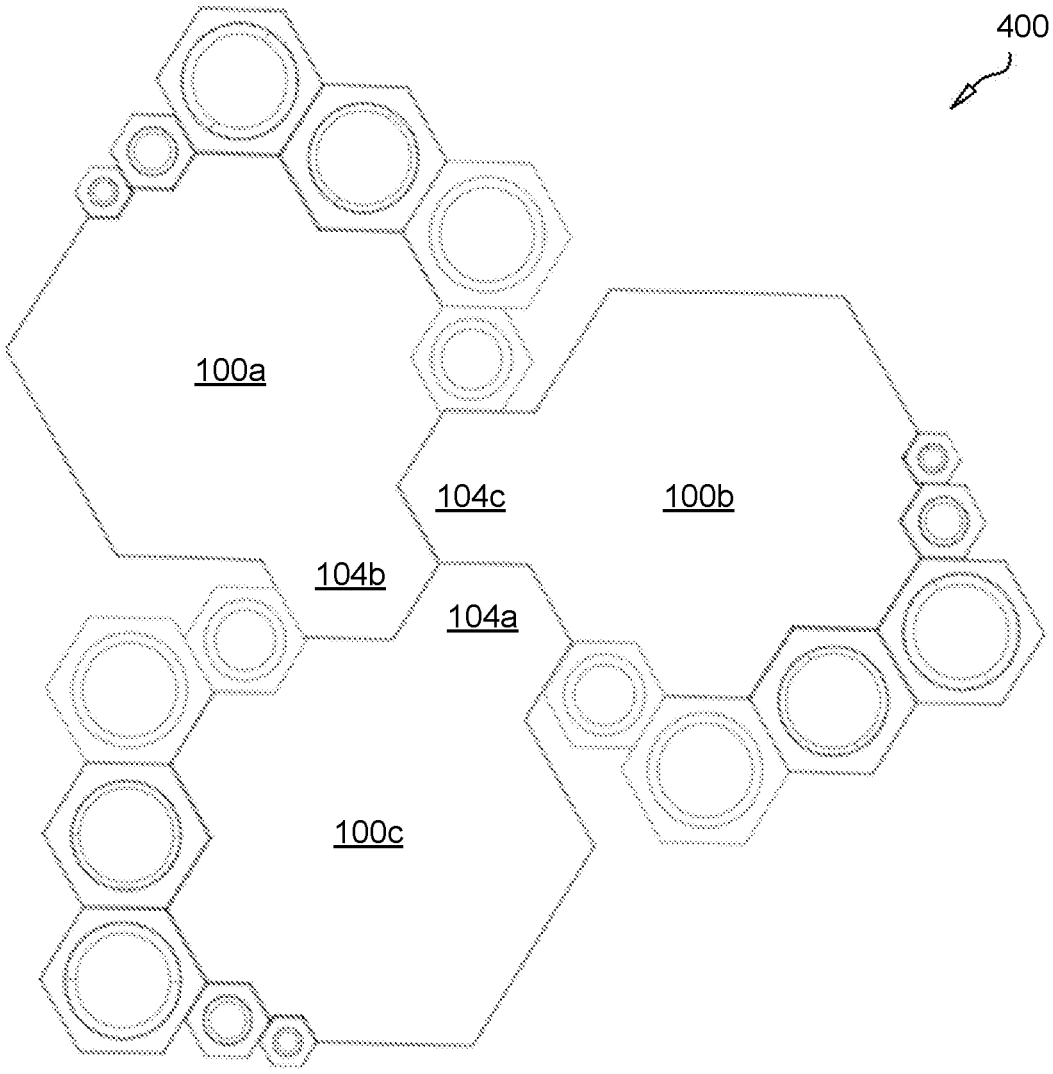
FIG. 4 illustrates a top view of three assembled protective desktop mats in accordance with the present invention.

FIG. 4 illustrates a top view of three assembled protective desktop mats in accordance with the present invention.

The three mats 100*a-c* form an assembly 400. Each of the tabs 104*a-c* interlock as shown with each tab 104 abutting the other two tabs 104 on two sides 110. The tabs 104 each consist of four edges, of which two are parallel.

Figure 5:
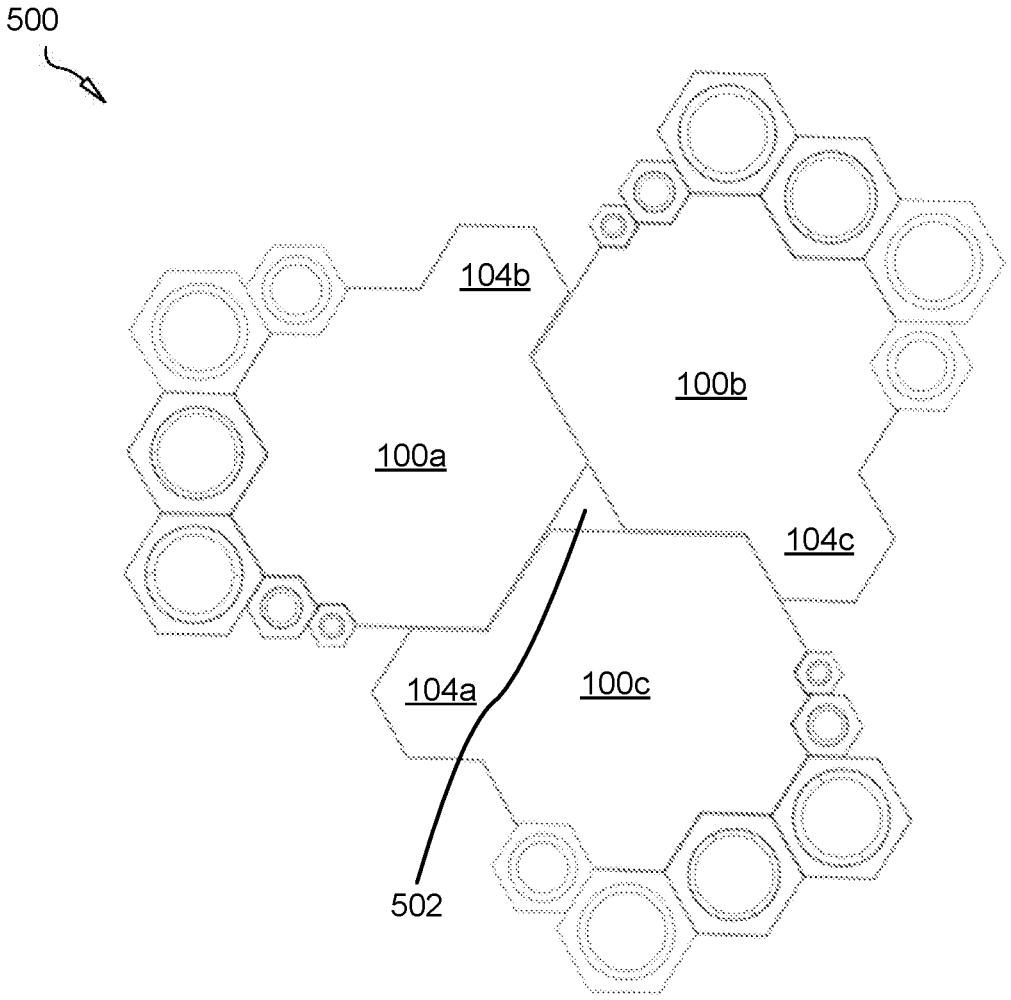
FIG. 5 illustrates a top view of three assembled protective desktop mats in accordance with the present invention.

FIG. 5 illustrates a top view of three assembled protective desktop mats in accordance with the present invention.

The three mats 100*a-c* form an assembly 500 which covers a larger surface area of a desktop surface. A triangular recess 502 forms between sides 108 of the mats 100*a-c*.

The desktop mats 100 may be formed as a single integrated piece from any flexibly, heat-resistant material, including silicone and polymeric materials. The mat 100 may be rolled and is portable. The mat 100 is designed to be heat-resistant and solvent resistant.

Figure 6:
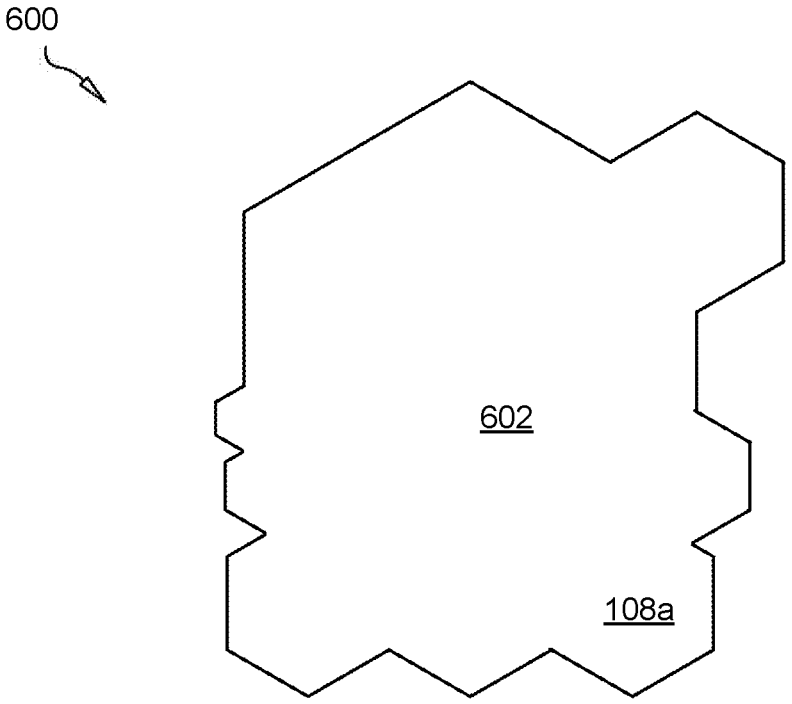
FIG. 6 illustrates a bottom view of an assembled protective desktop mat in accordance with the present invention.

FIG. 6 illustrates a bottom view of an assembled protective desktop mat 600 in accordance with the present invention.

One of the receptacles 108*a* may comprise one or more sides which are not attached to an adjacent receptacle nor to the main body 102. This allows the receptacle 108*a* to be lifted from the main body 102 in some embodiments, and to overlap an adjacent main body 102 or mat.

Figure 7:
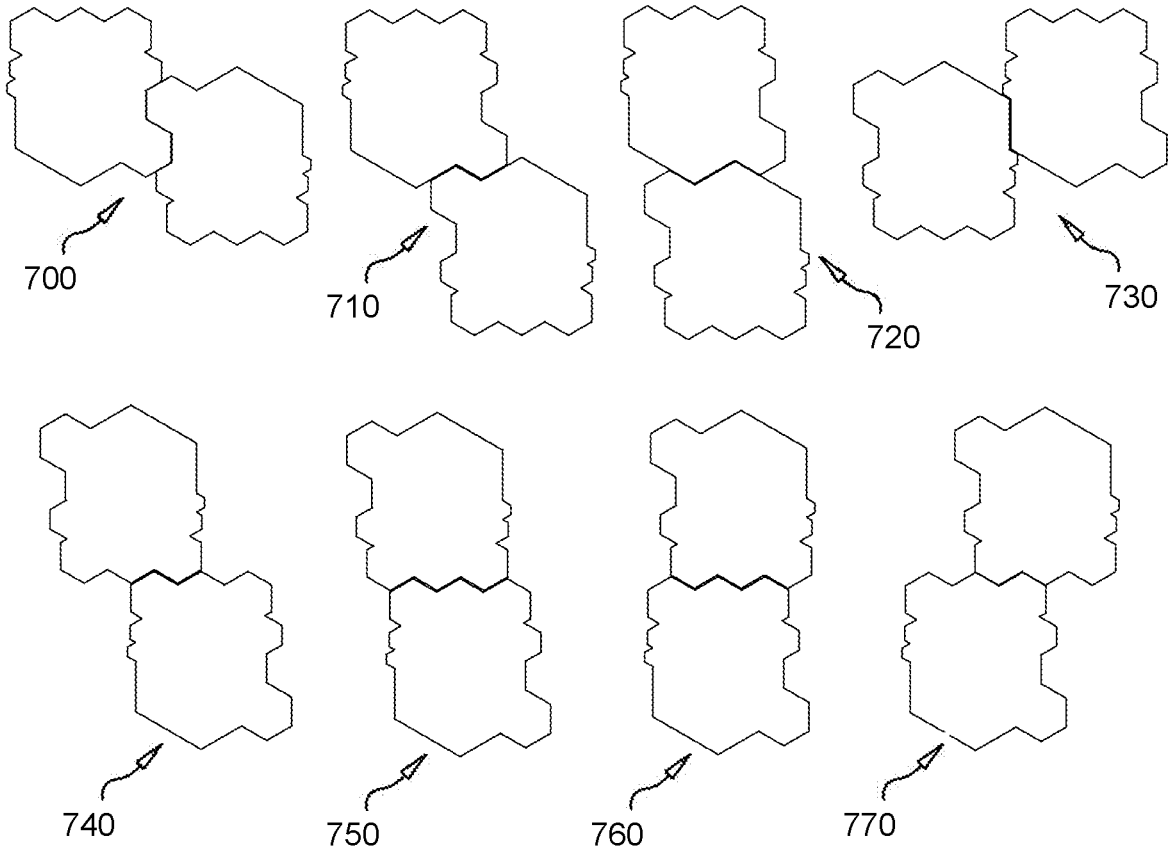
FIG. 7 illustrates an assemblage of six combinations of two desktop mats in accordance with the present invention.

FIG. 7 illustrates an assemblage of six combinations of two desktop mats in accordance with the present invention.

The combinations 700-770 are each exemplary combinations of two desktop mats 100. Each shows a different manner of arranging the mats 100 adjacent to one another to provide an optimal working space for users, including embodiment 700 in which the tabs 104 are adjacent, one above the other; embodiment 710 in which the tabs sit substantially side-by-side; embodiment 730 in which the tabs are disposed diametrically across the lateral axis; and other embodiments shown.

Figure 8:
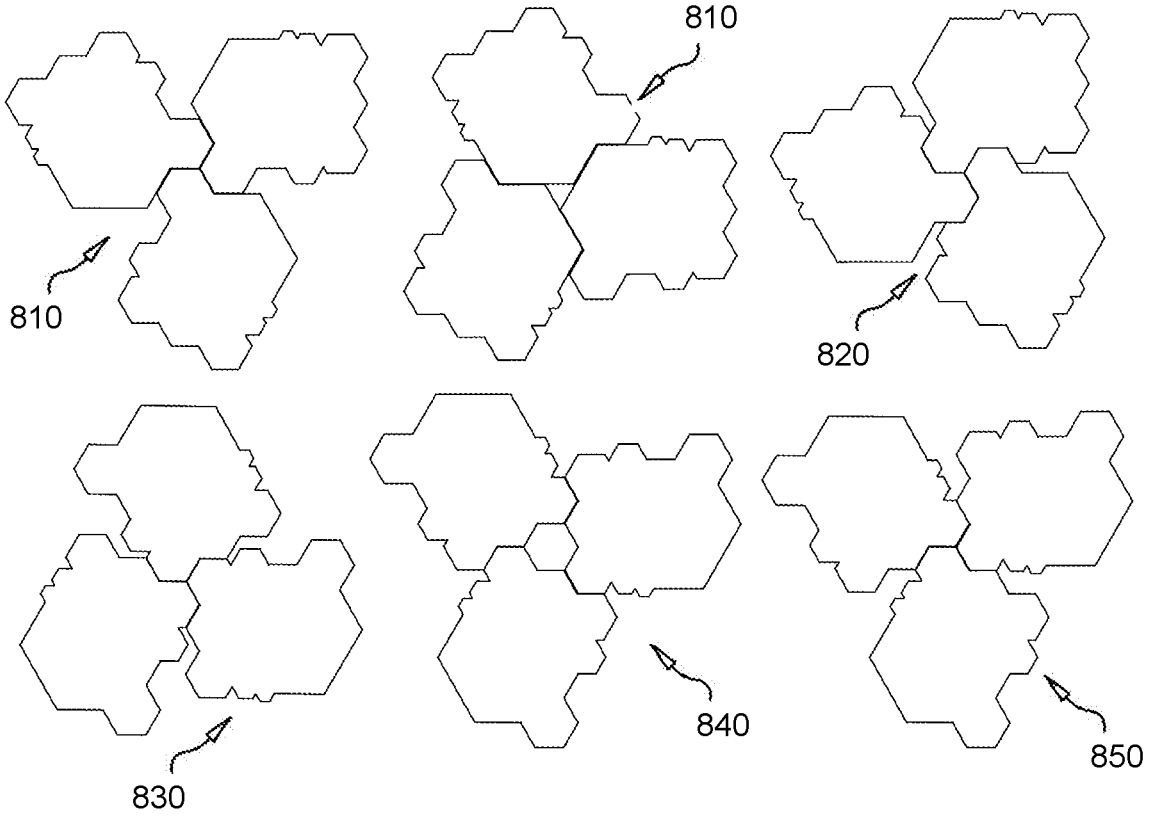
FIG. 8 illustrates an assemblage of six combinations of three desktop mats in accordance with the present invention.

FIG. 8 illustrates an assemblage of six combinations of three desktop mats in accordance with the present invention.

The combinations 800-850 are each exemplary combinations of three desktop mats 100. Each shows a different manner of arranging the mats 100 adjacent to one another to provide an optimal working space for a user, including embodiment 800, 820, 850 in which the tabs 104 are all adjacent; embodiment 810 in which the tabs sit substantially side-by-side; embodiment 830 in which the tabs all point in a counterclockwise direction; and other embodiments shown. In some embodiments, the mats 100 form a hexagonal recess such as that indicated at 840. In other embodiments, the mats 100 form a triangular recess such as that indicated at 810.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A protective desktop mat comprising:

a substantially hexagonal main body having a planar top surface and a planar bottom surface;

a substantially hexagonal tab protruding laterally from the main body, the substantially hexagonal tab having four or more exposed sides;

a plurality of hexagonal receptacles affixed to the main body, the hexagonal receptacles rising superiorly from the main body, the hexagonal receptacles circumscribing one or more edges of the main body, where in each hexagonal receptacle defines a cylindrical, hollow interior recess having an open top end.

2. The protective desktop mat of claim 1, wherein the main body, hexagonal tab and receptacles are all formed as a single integrated piece.

3. The protective desktop mat of claim 1, wherein the protective desktop mat is formed from silicone.

4. The protective desktop mat of claim 1, wherein each of the receptacles forms a hollow interior cylindrical recess having an open top surface.

5. The protective desktop mat of claim 1, wherein one or more receptacles are separated on one or more sides from one of an adjacent receptacle and the main body.

6. The protective desktop mat of claim 1, wherein two or more receptacles vary in diameter and depth from one or more remaining receptacles.

7. The protective desktop mat of claim 1, further comprising a plurality of hexagonal recesses defined by a top surface of the main body.

8. The protective desktop mat of claim 1, further comprising a plurality of elongated slots positioning between receptacles abutting one another, the elongated slots adapted to secure elongated handheld instruments.

9. The protective desktop mat of claim 1, wherein each receptacle comprises an annular lip which circumscribes a top end of a hollow interior recess.

10. The protective desktop mat of claim 9, wherein the lip is interrupted by one or more expansion joints.

11. The protective desktop mat of claim 1, wherein the receptacles are detachable.

12. The protective desktop mat of claim 1, further comprising a plurality of magnets disposed around a perimeter of the mat.

13. The protective desktop mat of claim 1, wherein a plurality of edges of the mat are predetermined to extend in length between 20-45% of the length of a longest edge of the mat.

* * * * *